US010024206B2

(12) United States Patent
Boyle et al.

(10) Patent No.: US 10,024,206 B2
(45) Date of Patent: Jul. 17, 2018

(54) SLIDING CAMSHAFT

(71) Applicant: GM GLOBAL TECHNOLOGY OPERATIONS LLC, Detroit, MI (US)

(72) Inventors: Brad B Boyle, Rochester, MI (US); Glenn E Clever, Washington, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 16 days.

(21) Appl. No.: 15/163,182

(22) Filed: May 24, 2016

(65) Prior Publication Data

US 2017/0342875 A1 Nov. 30, 2017

(51) Int. Cl.

| | |
|---|---|
| ***F01L 1/46*** | (2006.01) |
| ***F01L 13/00*** | (2006.01) |
| *F01L 1/344* | (2006.01) |
| *F01L 1/047* | (2006.01) |

(52) U.S. Cl.

CPC ..... *F01L 13/0036* (2013.01); *F01L 1/047* (2013.01); *F01L 1/34413* (2013.01); *F01L 13/0042* (2013.01); *F01L 2001/0473* (2013.01); *F01L 2013/0052* (2013.01); *F01L 2013/111* (2013.01); *F01L 2103/00* (2013.01); *F01L 2250/04* (2013.01); *F01L 2820/041* (2013.01)

(58) Field of Classification Search

CPC ..... F01L 2001/0473; F01L 1/34413; F01L 13/0042; F01L 2013/0052

USPC ..... 123/90.18

See application file for complete search history.

(56) References Cited

U.S. PATENT DOCUMENTS

| | | | | |
|---|---|---|---|---|
| 9,032,922 | B2 | 5/2015 | Moon et al. | |
| 2010/0242873 | A1* | 9/2010 | Meintschel | F01L 1/047 123/90.1 |
| 2012/0024245 | A1 | 2/2012 | Nendel | |
| 2014/0303873 | A1* | 10/2014 | Glugla | F01L 13/0036 701/103 |

FOREIGN PATENT DOCUMENTS

| | | | |
|---|---|---|---|
| DE | 102008032026 | A1 | 1/2010 |
| JP | 2009191736 | A | 8/2009 |
| KR | 101438315 | B1 | 9/2014 |

* cited by examiner

*Primary Examiner* — Jorge Leon, Jr.

(57) ABSTRACT

A sliding camshaft is provided which may include a base shaft, an over-molded trigger wheel, and a distal axially movable structure. The distal axially movable structure may further include a distal journal in addition to at least one standard journal and lobe packs. A control groove is defined in the distal axially movable structure. The over-molded trigger wheel is mounted on the distal axially movable structure. The over-molded trigger wheel is operatively configured to move between at least a first position and a second position together with the distal axially movable structure via engagement between the control groove and an actuator. The over-molded trigger wheel may be press fitted on distal axially movable structure and is adapted to accurately communicate with a sensor regardless of the position of the distal axially movable structure.

5 Claims, 9 Drawing Sheets

SLIDING CAMSHAFT

TECHNICAL FIELD

The present disclosure relates to a sliding camshaft for a vehicle engine.

INTRODUCTION

Vehicles typically include an engine assembly for propulsion. The engine assembly may include an internal combustion engine defining one or more cylinders. In addition, the engine assembly may include intake valves for controlling the inlet charge into the cylinders and exhaust valves for controlling the flow of exhaust gases out of the cylinders. The engine assembly may further include a valve train system for controlling the operation of the intake and exhaust valves. The valve train system includes a camshaft for moving the intake and exhaust valves.

The rotation of the camshaft (and movement of the valve train system) is coordinated with the crankshaft assembly via a timing belt on one end of the camshaft and a trigger wheel on the opposite end of the cam shaft. The trigger wheel 4 is traditionally press-fitted on the camshaft as shown in FIGS. 1A, 1C and 1D. The trigger wheel 4 may define a profile with teeth (as shown in FIG. 1B) which may varying dimensions wherein a gap may exist between the teeth. It is further understood that the defined gaps may also have varying dimensions.

With references to FIGS. 1C and 1D, the camshaft sensor 69 is shown in conjunction with a traditional camshaft 2. The camshaft sensor 69 obtains data regarding the angular position of the camshaft 2 via the trigger wheel 4 and relays such information to the engine control module (not shown). The engine control unit ("ECU") uses that data, along with inputs from other sensors, to control systems such as ignition timing and fuel injection. Deviation from the ideal timing is likely to result in sub-optimum engine performance.

In order for the engine to function efficiently, the ECU must be able to determine which cylinder is in the compression stroke and ignite a spark at the right time to such cylinder in order to produce maximum combustion. The ECU must also be able to determine which cylinder is in the intake stroke so as to direct the fuel injectors to inject fuel to such cylinder at the right time (and with the aid of other sensors, the right amount of fuel).

The ECU is able to make this determination by combining data from the crankshaft position sensor and the camshaft position sensor. As indicated, the crankshaft position sensor monitors the angular position of the crankshaft and sends a signal to the ECU which enables the ECU to determine the position of the piston in each cylinder. The camshaft position sensor 69, on the other hand, monitors the position of the camshaft 2 (or in effect, the position of the valves) and sends this information to the ECU. Accordingly, through these two signals, the ECU is able to tell which cylinder is in the compression stroke and which one is in the intake stroke. This is, of course, under the presumption that the timing marks of the crankshaft and that of the camshaft are properly set, and the timing wheels for both the camshaft and the crankshaft are rotating about an axis that is in alignment with the axis of the camshaft and the crankshaft respectively.

In cases where the axis 6 of the trigger wheel 4 is not perfectly aligned with the axis 8 of the camshaft as shown in FIGS. 1C and 1D, runout of the trigger wheel 4 may occur. As shown, the trigger wheel 4 rotates in an irregular fashion as shown in FIGS. 1C and 1D. In FIG. 1C, the trigger wheel's 4 rotation is in a zero degree position, and the radial distance between the trigger wheel 4 and the sensor 69 is increased relative to when the trigger wheel 4 rotation is in a 180 degree position (see FIG. 1D). This results in inaccurate readings from the sensor 69 due to irregular radial distance between the trigger wheel 45 and the sensor 69.

When the ECU obtains defective data due to the runout of the trigger wheel 4, this may result in slight out-of-sync movement between camshaft 2 relative to the crankshaft which further results in inefficiencies in engine performance. Therefore, accurate data is important in order to keep all the parts of the engine well timed and working in concert. Accordingly, there is a need to address the issue regarding run-out in the trigger wheel 4 (or timing/target wheel) of the engine in order to have accurate data provided to the ECU and provide optimum engine performance.

SUMMARY

A sliding camshaft is provided which may include a base shaft, an over-molded trigger wheel, and a distal axially movable structure. The distal axially movable structure may further include a distal journal in addition to at least one standard journal and lobe packs. A control groove is defined in the distal axially movable structure. The over-molded trigger wheel is mounted on the distal axially movable structure. The over-molded trigger wheel is operatively configured to move between at least a first position and a second position together with the distal axially movable structure via engagement between the control groove and an actuator. The over-molded trigger wheel may be press fitted on distal axially movable structure and is adapted to accurately communicate with a sensor regardless of the position of the distal axially movable structure.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The processes, methods, or algorithms disclosed herein can be deliverable to/implemented by a processing device, controller, or computer, which can include any existing programmable electronic control unit or dedicated electronic control unit.

Figure 1A:
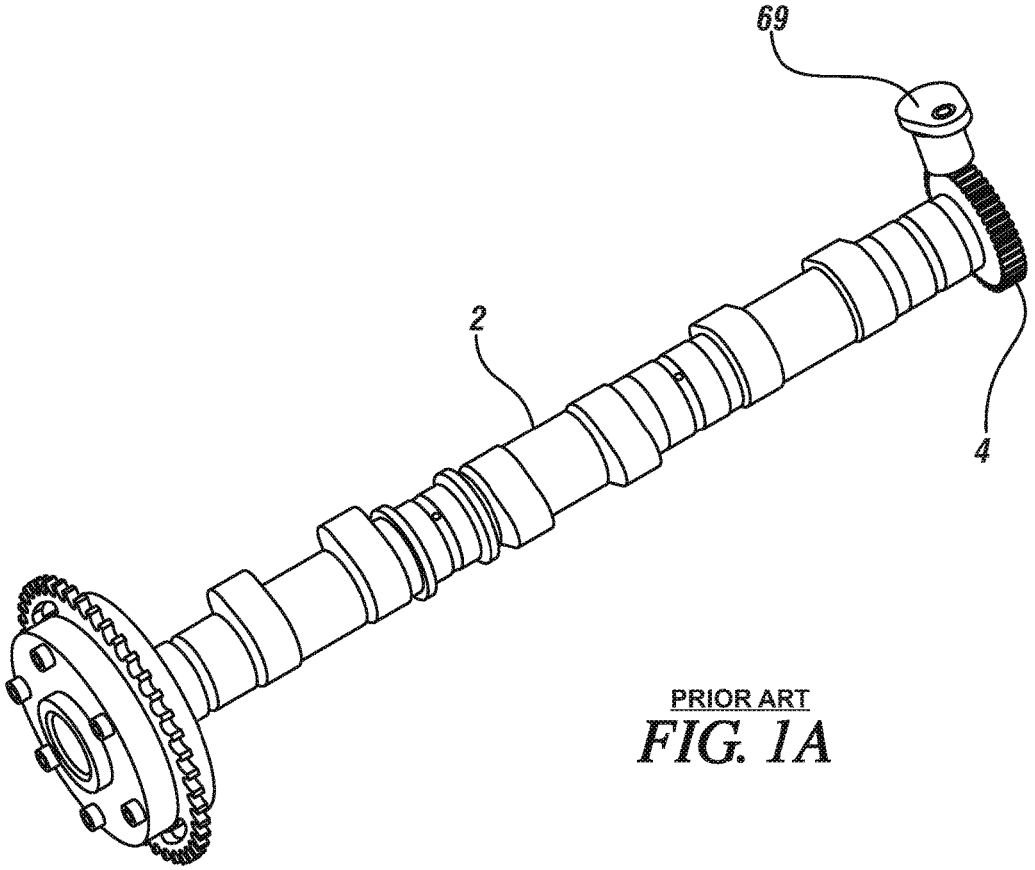
PRIOR ART FIG. 1A
FIG. 1A illustrates a traditional camshaft having cams and a trigger wheel.
Figure 1B:
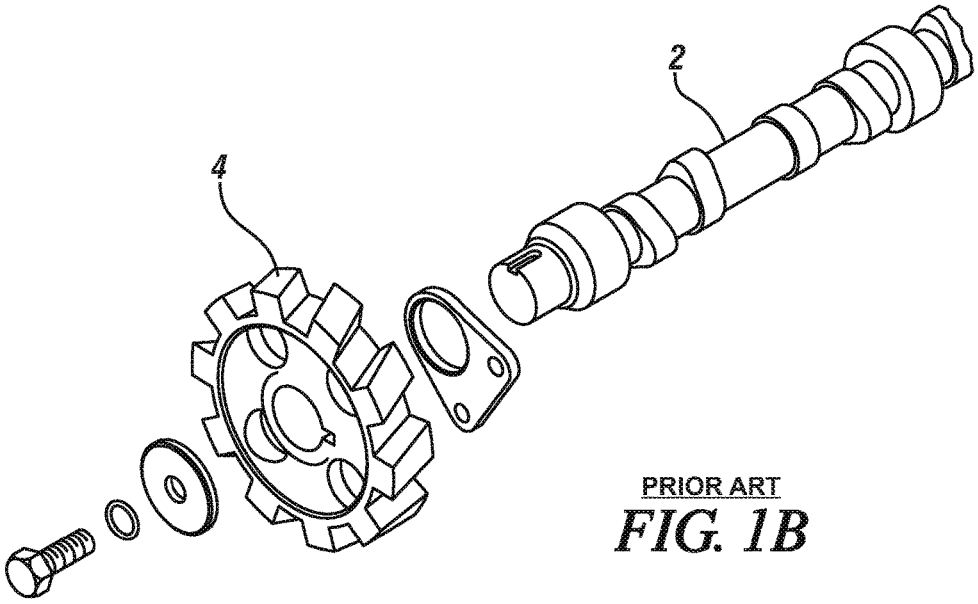
PRIOR ART FIG. 1B
FIG. 1B illustrates an expanded view of another traditional camshaft having cams and a trigger wheel 45.
Figure 1C:
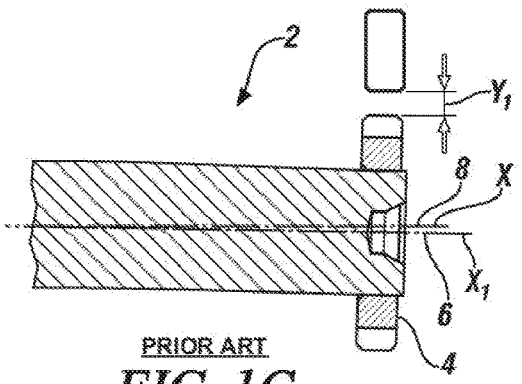
PRIOR ART FIG. 1C
FIG. 1C illustrates a cross-sectional view of a traditional camshaft in conjunction with a camshaft sensor where the trigger wheel is rotating off-center and is in a zero degree position.
Figure 1D:
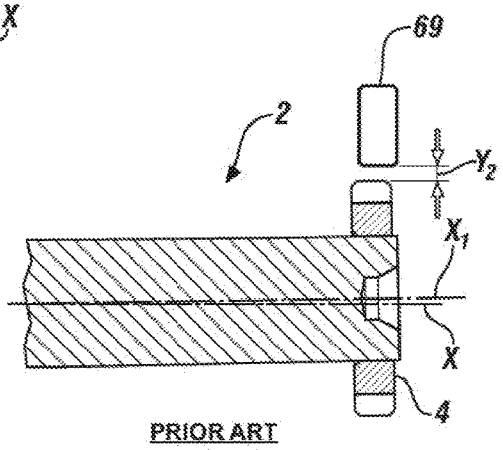
PRIOR ART FIG. 1D
FIG. 1D illustrates a cross-sectional view of the traditional camshaft in conjunction with a camshaft sensor where the trigger wheel 45 is rotating off-center and is in a 180 degree position.
Figure 2:
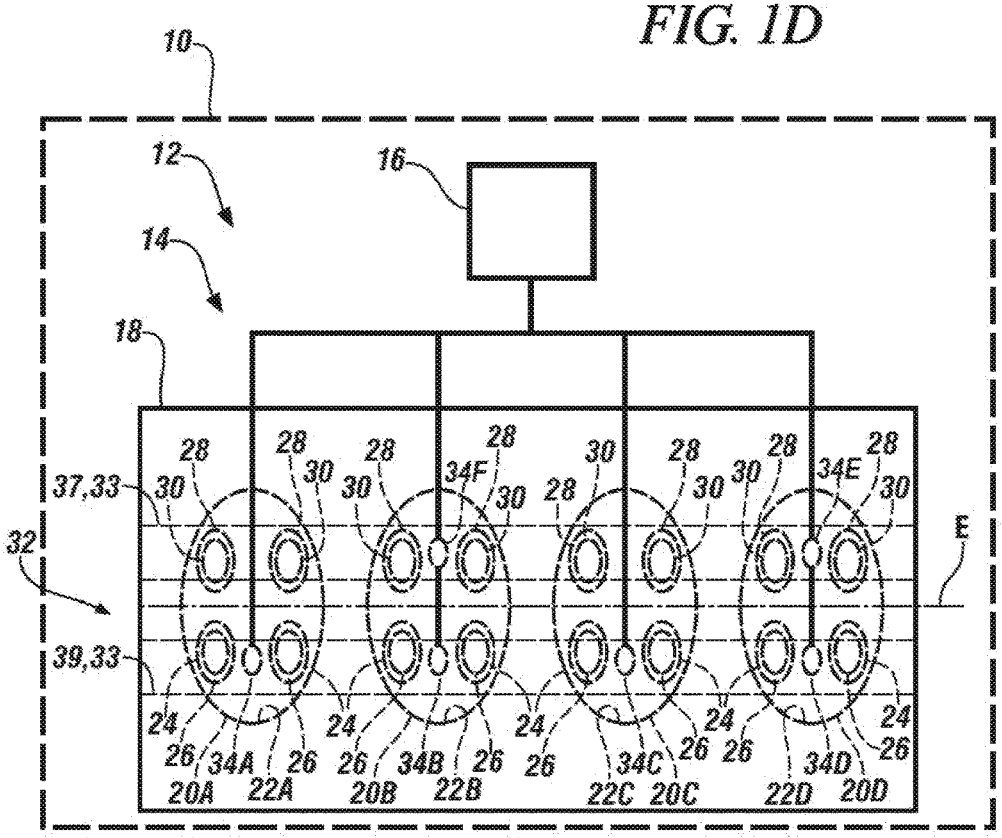
FIG. 2 illustrates a schematic diagram of an engine assembly.

Exemplary components and systems described herein are used to improve engine performance by reducing the possibility for runout to occur in the trigger wheel 45 of the engine. Referring to FIG. 2, a schematic drawing is provided which shows a vehicle such as a car, truck or motorcycle. The vehicle 10 includes an engine assembly 12. The engine assembly 12 includes an internal combustion engine 14 and a control module 16, such engine control module (ECU) 16, is in electronic communication with the internal combustion engine 14. The terms "control module," "module," "control," "controller," "control unit," "processor" and similar terms mean any one or various combinations of one or more of Application of Specific Integrated Circuit(s) (ASIC), electronic circuit(s), central processing units executing one or more software or firmware routines, combinational logic circuit(s), sequential logic circuits, input/output circuit(s) and devices, appropriate signal conditioning and buffer circuitry, and other components to provide the above functionality. "Software," "firmware," "programs," "instructions," "routines," "code," "algorithm," and similar terms means any controller executable instruction sets including calibrations and look-up tables. The control module may have a set of control routines executed to provide the described functionality. Routines are executed, such as by a central processing unit, and are operable to monitor inputs from sensing devices and other network control modules, and execute control and diagnostic routines to control operation of actuators. Routines may be executed based on events or at regular intervals.

The internal combustion engine 14 includes an engine block 18 defining a plurality of cylinders 20A, 20B, 20C, 20D. In other words, the engine block 18 includes a first cylinder 20A, a second cylinder 20B, a third cylinder 20C, and a fourth cylinder 20D. Although FIG. 2 schematically illustrates four cylinders, the internal combustion engine 14 may include fewer or more cylinders. The cylinders are spaced apart from each other but may be substantially aligned along an engine axis E. Each of the pistons is configured to reciprocate within each corresponding cylinder 20A, 20B, 20C, and 20D. Each cylinder 20A, 20B, 20C, 20D defines a corresponding combustion chamber 22A, 22B, 22C. During the operation of the internal combustion engine 14, an air/fuel mixture is combusted inside the combustion chambers 22A, 22B, 22C, 22D in order to drive the pistons in a reciprocating manner. The reciprocating motion of the pistons drive a crankshaft (not shown) operatively connected to the wheels (not shown) of the vehicle. The rotation of the crankshaft can cause the wheels to rotate, thereby propelling the vehicle.

In order to propel the vehicle, an air fuel mixture should be introduced into the combustion chambers. To do so, the internal combustion engine 14 includes a plurality of intake ports fluidly coupled to an intake manifold (not shown). In the depicted embodiment, the internal combustion engine 14 includes two intake ports in fluid communication with each combustion chamber 22A, 22B, 22C, 22D. However, the internal combustion engine 14 may include more or fewer intake ports per combustion chamber 22A, 22B, 22C, 22D. The internal combustion engine 14 therefore contains at least one intake port per cylinder 20A, 20B, 20C, 20D.

The internal combustion engine 14 further includes a plurality of intake valves 26 configured to control the flow of inlet charge through the intake ports 24. The number of intake valves 26 which corresponds to the number of intake ports 24. Each intake valve 26 is at least partially disposed within a corresponding intake port 24. In particular, each intake valve 26 is configured to move along the corresponding intake port 24 between an open position and a closed position. In the open position, the intake valve 26 allows inlet charge to enter a corresponding combustion chamber 22A, 22B, 22C, 22D via the corresponding intake port 24. Conversely, in the closed position, the intake valve 26 precludes the inlet charge from entering the corresponding combustion chamber 22A, 22B, 22C, or 22D via the intake port 24.

As discussed above, the internal combustion engine 14 can combust the air/fuel mixture once the air/fuel mixture enters the combustion chamber 22A, 22B, 22C, or 22D. For example, the internal combustion engine 14 can combust the air/fuel mixture in the combustion chamber 22A, 22B, 22C, 22D using an ignition system (not shown). This combustion generates exhaust gases. To expel these exhaust gases, the internal combustion engine 14 defines a plurality of exhaust ports 28. The exhaust ports 28 are in fluid communication with the combustion chambers 22A, 22B, 22C, 22D. In the depicted embodiment, two exhaust ports 28 for each combustion chamber 22A, 22B, 22C, 22D are in fluid communication with each combustion chamber 22A, 22B, 22C, 22D. However, more or fewer exhaust ports 28 may be fluidly coupled to each combustion chamber 22A, 22B, 22C, 22D. The internal combustion chamber includes at least one exhaust port per cylinder 20A, 20B, 20C, 20D.

The internal combustion engine 14 further includes a plurality of exhaust valves 30 in fluid communication with the combustion chambers 22A, 22B, 22C, 22D. Each exhaust valve 30 is at least partially disposed within a corresponding exhaust port 28. In particular, each exhaust valve 30 is configured to move along the corresponding exhaust port 28 between an open position and a closed position. In the open position, the exhaust valve 30 allows the exhaust gases to escape the corresponding combustion chamber 22A, 22B, 22C, 22D via the corresponding exhaust port 28. In particular, each exhaust valve 30 is configured to move along the corresponding exhaust port 28 between an open position and a closed position. In the open position, the exhaust valve 30 allows the exhaust gases to escape the corresponding combustion chamber 22A, 22B, 22C, 22D via the corresponding exhaust port.

The intake valve 26 and exhaust valve 30 can also be generally referred to as engine valves 66. Each valve 26, 30 is operatively coupled or associated with a cylinder 20A, 20B, 20C, 20D. Each valve 66 (FIG. 7) are configured to control fluid flow (i.e. air/fuel mixture for intake valves 26 and exhaust gas valve 30) to the corresponding cylinder 20A, 20B, 20C, 20D. The valves 66 operatively coupled to the fourth cylinder 20D can be referred to as fourth valves.

As shown, the engine assembly 12 includes a valve train system 32 configured to control the operation of the intake valves 26 and exhaust valves 30. Specifically, the valve train system 32 can move the intake valves 26 and exhaust valves 30 between the open and closed positions as dictated by the ECU 16 and based at least in part on the operating conditions of the internal combustion engine 14 (e.g., engine speed). The valve train system 32 includes one or more sliding camshafts 33 substantially parallel to the engine axis E along with the associated cams on each sliding camshaft. The intake sliding camshaft 39 is configured to control the operation of the intake valves 26, and the exhaust sliding camshaft 37 can control the operation of the exhaust valves 30. It is contemplated, however, that the valve train system 32 may include more or fewer sliding camshafts 33.

Figure 6A:
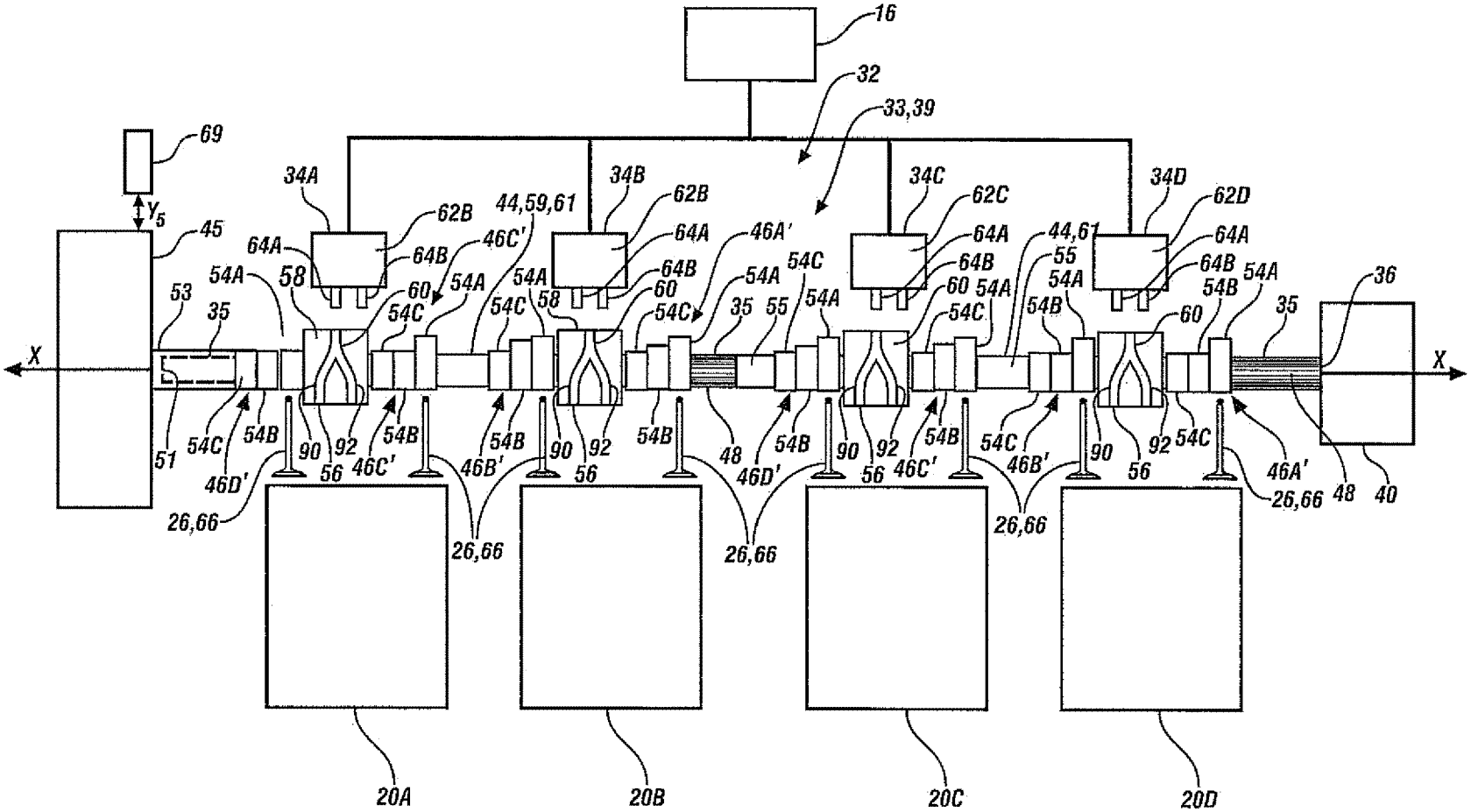
FIG. 6A illustrates a schematic side view of a third embodiment of the present disclosure where the sliding camshaft is dedicated to the intake valves and the axially movable structures are in a first position.
Figure 6B:
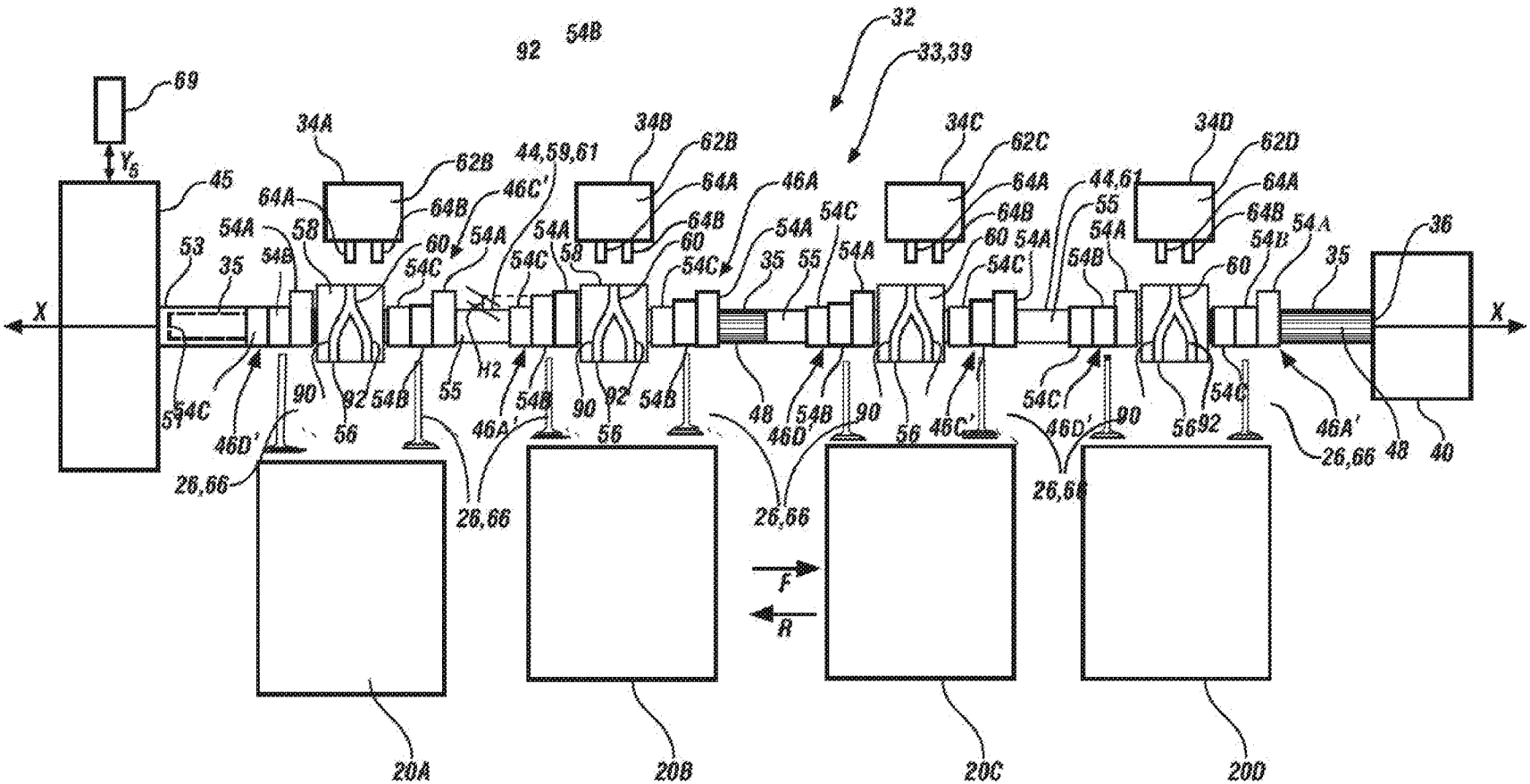
FIG. 6B illustrates a schematic side view of a third embodiment of the present disclosure where the sliding camshaft is dedicated to the intake valves and the axially movable structures are in a second position.
Figure 6C:
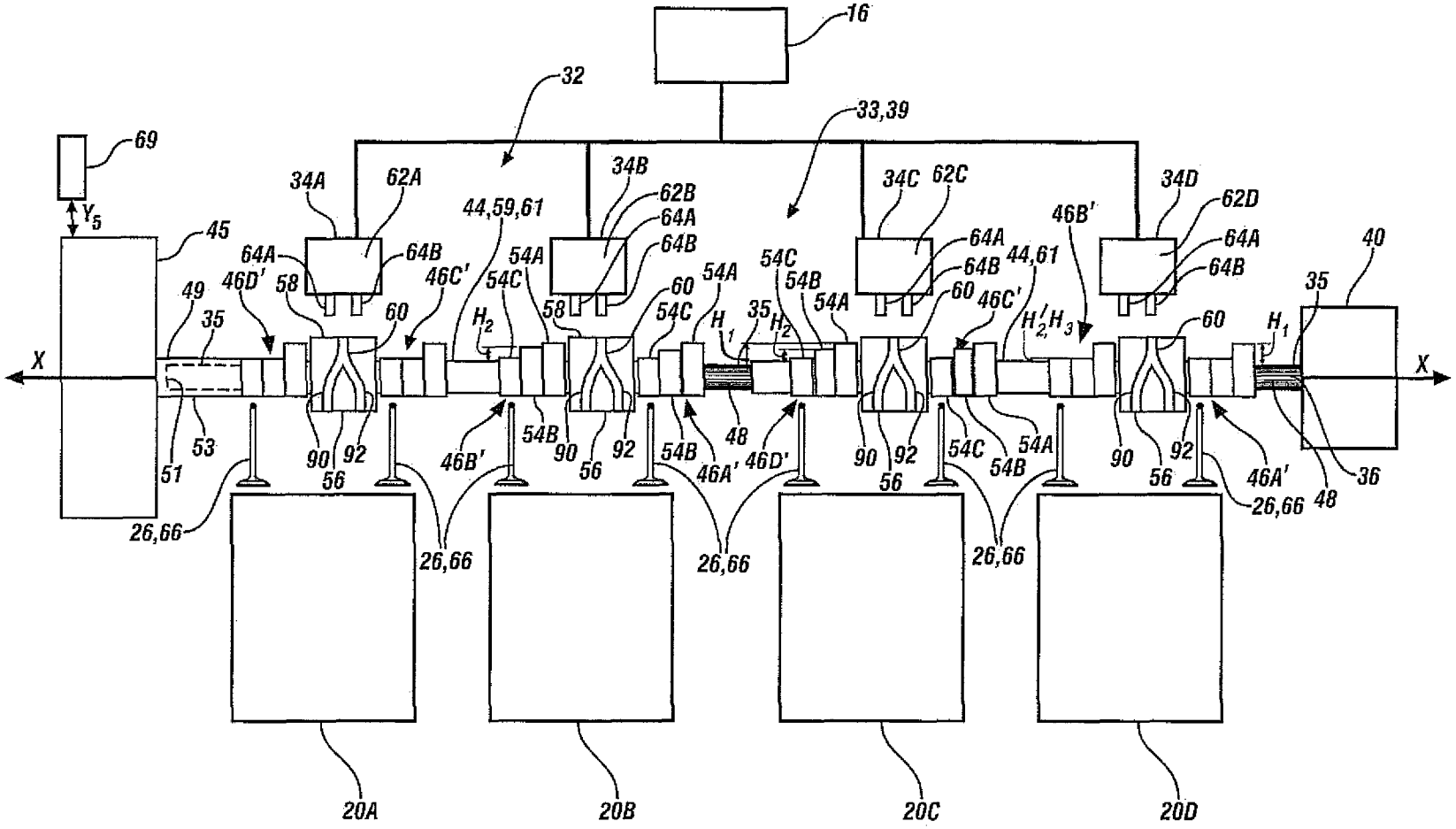
FIG. 6C illustrates a schematic side view of a third embodiment of the present disclosure where the sliding camshaft is dedicated to the intake valves and the axially movable structures are in a third position.

In addition to the sliding camshafts 33, the valve train assembly 32 includes a plurality of actuators 34A, 34B, 34C, 34D, 34E, 34F such as solenoids, in communication with the control module 16. With reference to FIGS. 6A-6C, the actuators 34A, 34B, 34C, 34D may be electronically connected to the control module 16 and may therefore be in electronic communication with the control module 16. The control module 16 may be part of the valve train system 32. In the depicted embodiment shown in FIG. 6A, the valve train system 32 includes first, second, third, and fourth intake actuators 34A, 34B, 34C, 34D. The first intake actuator 34A and second intake actuator 34B are operatively associated with the first cylinder 20A and the second cylinder 20B. The first and second intake actuators 34A, 34B can be actuated to control the operation of the intake valves 26. The third intake actuator 34C and the fourth intake actuator 34D are operatively associated with the third and fourth cylinders (shown as 20C and 20D respectively). It is to be understood that two actuators (34A and 34B, 34C and 34D as shown in FIGS. 6A-6C) may be implemented for each axially movable structure 44, 59 with respect to the intake valves 26 given that the intake sliding camshaft 39 as shown (and in contrast to the exhaust sliding camshaft 37) implement two three step cams on each axially movable structure 44. In order to accommodate the weight of the three step cams, two actuators (34A and 34B, 34C and 34D) may be sufficient to slide the axially movable structure 44, 59. With respect to actuators 34A and 34B, actuators 34A and 34B are operatively configured to move trigger wheel 45 together with distal axially movable structure 59.

Figure 3:
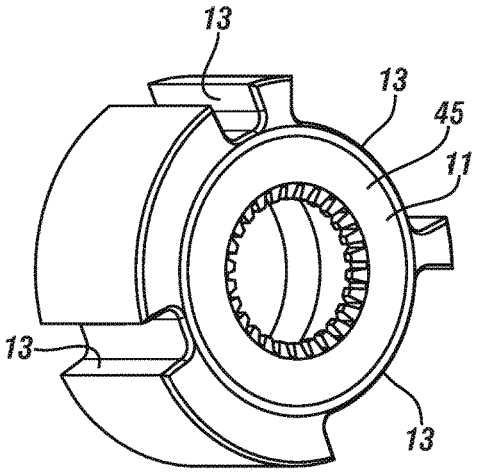
FIG. 3 illustrates an isometric view of a second embodiment of the present disclosure where the trigger wheel is formed solely from a metallic material.
Figure 4:
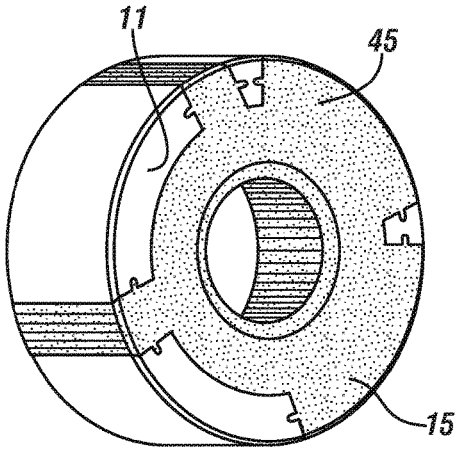
FIG. 4 illustrates an isometric view of the first embodiment of the present disclosure where the trigger wheel has a flat outer edge and is formed from both metal and a polymeric material.

As shown in FIG. 3, the trigger wheel 45 may be formed solely of a metal core 11 wherein gaps 13 are disposed along the circumference of the trigger wheel 45. Alternatively, as shown in FIG. 4, the trigger wheel 45 may be formed of both a polymeric material 15 and the metal core 11 wherein the polymeric material 15 is injected molded onto the metal core 11.

Figure 7A:
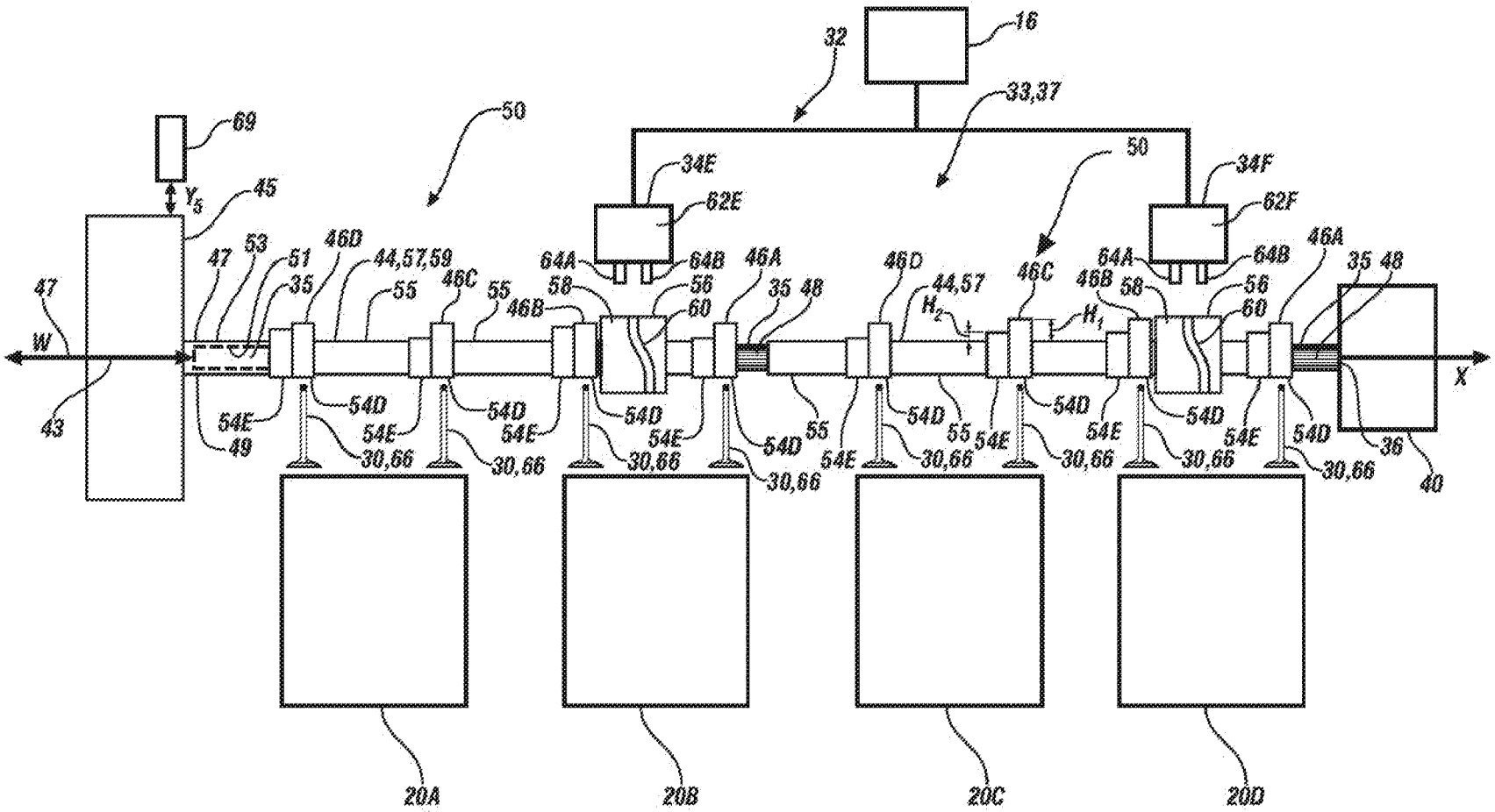
FIG. 7A illustrates a schematic side view of a fourth embodiment of the present disclosure where the sliding camshaft is dedicated to the exhaust valves and the axially movable structures are in a first position.
Figure 7B:
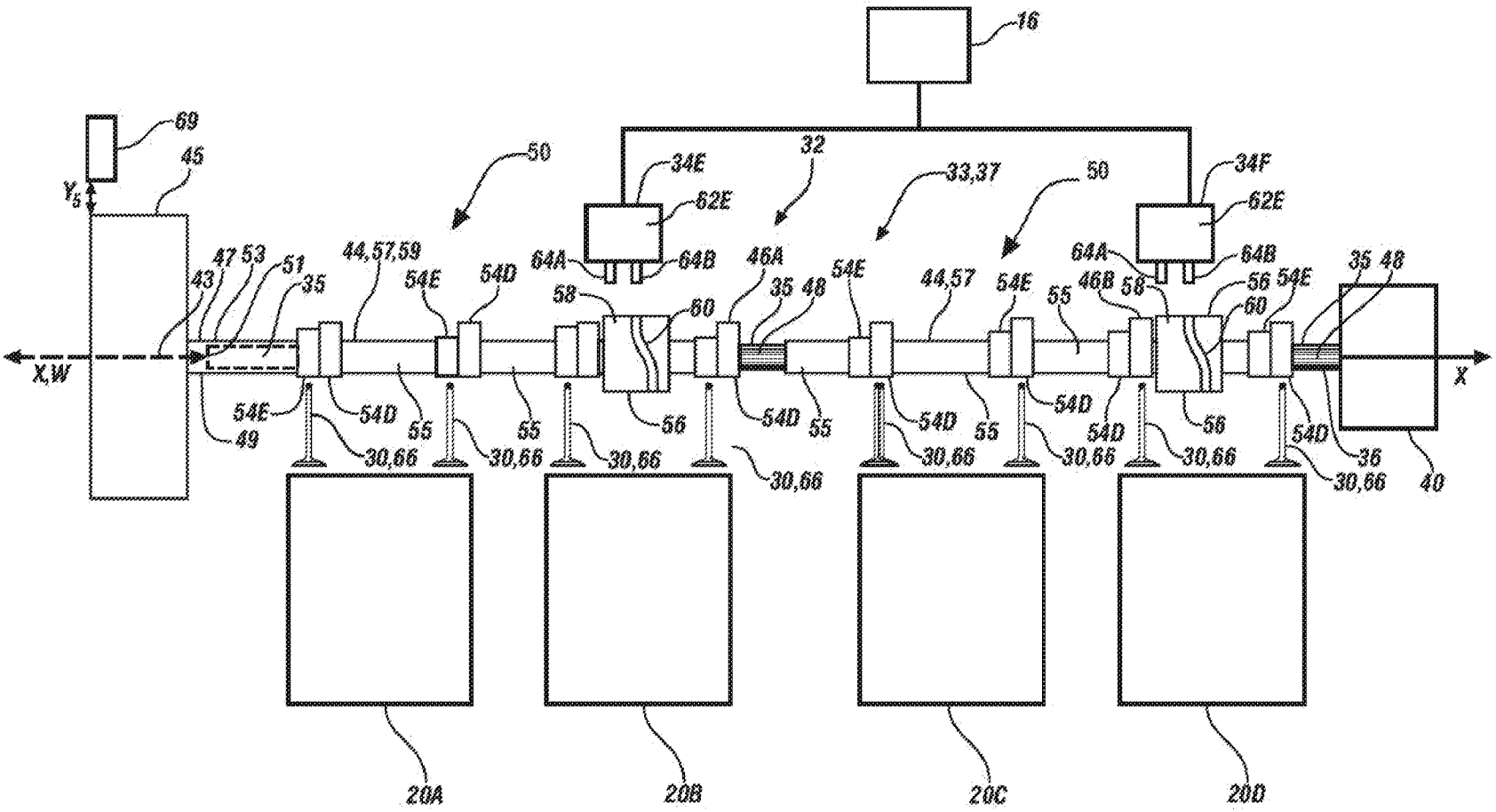
FIG. 7B illustrates a schematic side view of a fourth embodiment of the present disclosure where the sliding camshaft is dedicated to the exhaust valves and the axially movable structures are in a second position.

Referring now to FIGS. 7A and 7B, the first exhaust actuator 34E is operatively associated with the first and second cylinders 20A and 20B and can be actuated to control the axial movement of the trigger wheel 45 and distal axially movable structure 59 in FIGS. 7A and 7B as well as the operation of the exhaust valves 30 of the first and second cylinders (shown as 20A and 20B respectively in FIGS. 7A-7B). The second exhaust actuator 34F is operatively associated with the third and fourth cylinders (shown as 20C and 20D respectively). The second exhaust actuator 34F can be actuated to control the axially movable structure 44 as well as the operation of the exhaust valves 30 of the third and fourth cylinders 20C and 20D.

With reference back to FIG. 2, the valve train system 32 includes two sliding camshafts 33 (exhaust sliding camshaft 37 and the intake sliding camshaft 39) and the actuators 34A, 34B, 34C, 34D, 34E, 34F as discussed above. Each sliding camshaft 33, 37, 39 includes a base shaft 35 extending along a longitudinal axis X. Thus, each base shaft 35 extends along the longitudinal axis X. The base shaft 35 may also be referred to as the support shaft and includes a proximate end 36 and a distal end 51 opposite the proximate end 36.

Moreover, each sliding camshaft 33 includes a coupler 40 connected to the proximate end 36 of the base shaft 35. The coupler 40 can be used to operatively couple the base shaft 35 to the crankshaft (not shown) of the engine 14. The crankshaft of the engine 14 can drive the base shaft 35. Accordingly, the base shaft 35 can rotate about the longitudinal axis X when driven by, for example, the crankshaft (not shown) of the engine 14. The rotation of the base shaft 35 causes the entire sliding camshaft 33 to rotate about each respective longitudinal axis X. The base shaft 35 is therefore operatively coupled to the internal combustion engine 14.

Each sliding camshaft 33 in FIGS. 6A-6C and FIGS. 7A-7B each further includes one or more axially movable structures 44 mounted on the base shaft 35. The axially movable structures 44 may also be referred to as the lobe pack assemblies. As shown, each sliding camshaft 33 include a distal axially movable structure 59 having an integral distal journal 53 wherein a trigger wheel 45 is mounted to each distal journal 53. The axially movable structures 44 are configured to move axially relative to the base shaft 35 along the longitudinal axis X. However, the axially movable structures 44 are rotationally fixed to the base shaft 35. Consequently, the axially movable structures 44 rotate synchronously with the base shaft 35. The base shaft 35 may include a spline feature 48 (shown in FIGS. 6A-6C and FIGS. 7A-7B) for maintaining angular alignment of the axially movable structures 44 to the base shaft 35 and also for transmitting drive torque between the base shaft 35 and the axially movable structures 44.

As noted above, FIGS. 6A-6C and FIGS. 7A-7B depict each sliding camshaft 33 (shown as the exhaust sliding camshaft 37 in FIGS. 7A-7B and intake sliding camshaft 39 in FIGS. 6A-6C). As shown, each sliding camshaft 33 includes two axially movable structures 44 wherein a trigger wheel 45 is mounted on the distal end 49 of distal journal 53 of distal axially movable structure 59. It is to be understood that the distal axially movable structure 59 is the axially movable structure 44 which is disposed on the base shaft 35 closest to the distal end 51 of the base shaft 35. It is nevertheless contemplated that sliding camshaft 33 may include more or fewer axially movable structures 44 with each sliding camshaft 33 having one distal axially movable structure 59. Regardless of the quantity of axially movable structure 44 on the base shaft 35, the axially movable structures 44 are axially spaced apart from each other along the longitudinal axis X. With specific reference to the exhaust sliding camshaft 37 of FIGS. 7A and 7B, each axially movable structure 44 on sliding camshaft 33, 37 includes a first lobe pack 46A, a second lobe pack 46B, a third lobe pack 46C, and a fourth lobe pack 46D coupled to one another via a monolithic structure. As shown, base shaft 35 extends along a longitudinal axis, and the base shaft is configured to rotate about the longitudinal axis. A distal axially movable structure is mounted on the base shaft. The distal axially movable structure may be axially movable relative to the base shaft between a first position (shown in FIG. 7A) and a second position (shown in FIG. 7B). The distal axially movable structure 59 may be rotationally fixed to the base shaft. As shown, the axially movable structure 57 mounted on the base shaft 35 is axially spaced from the distal axially movable structure 59. Moreover, an over-molded trigger wheel (shown as 45 in FIG. 4, FIG. 7A, FIG. 7B) may be affixed to the distal axially movable structure via a press fit or other alternative means.

Distal journal 53 is formed on the distal side of the distal axially movable structure 59. The distal axially movable structure 44, 59 (via distal journal 53) may, but not necessarily, be configured to engage with trigger wheel 45 such that the trigger wheel 45 is mounted on the distal journal 53. When the trigger wheel 45 is mounted to the distal journal 53 (instead of the base shaft 35), the axis of the trigger wheel 45 is substantially aligned with the base shaft 35 axis and the axis of the axially movable structure such that the runout condition of the trigger wheel 45 is significantly reduced or eliminated. Accordingly, the distance (shown as $Y_5$ in FIGS. 7A-7B) between the trigger wheel 45 and the camshaft sensor remains substantially constant such that the camshaft sensor 69 obtains accurate data from the rotating trigger wheel 45. To the extent $Y_5$ fluctuates, the distance may vary up to approximately 100 microns (instead of 300 microns under prior art designs). Accordingly, the camshaft sensor 69 conveys accurate data to the ECU 16 to allow the engine to operate more efficiently.

Referring again to FIGS. 7A and 7B, the first, second, third, and fourth lobe packs 46A, 46B, 46C, 46D may also be referred to as cam packs. In addition, each axially movable structure 44 may, but not necessarily, include one barrel cam 56. It is understood that when a three step cam is used for each valve (as shown in FIGS. 6A-6C), two barrel cams 56 may be formed in each axially movable structure 44 given that two actuators (34A and 34B, 34C and 34D shown in FIGS. 6A-6C) may be needed to move the heavier axially movable structure 44 having a three step cam.

Figure 5:
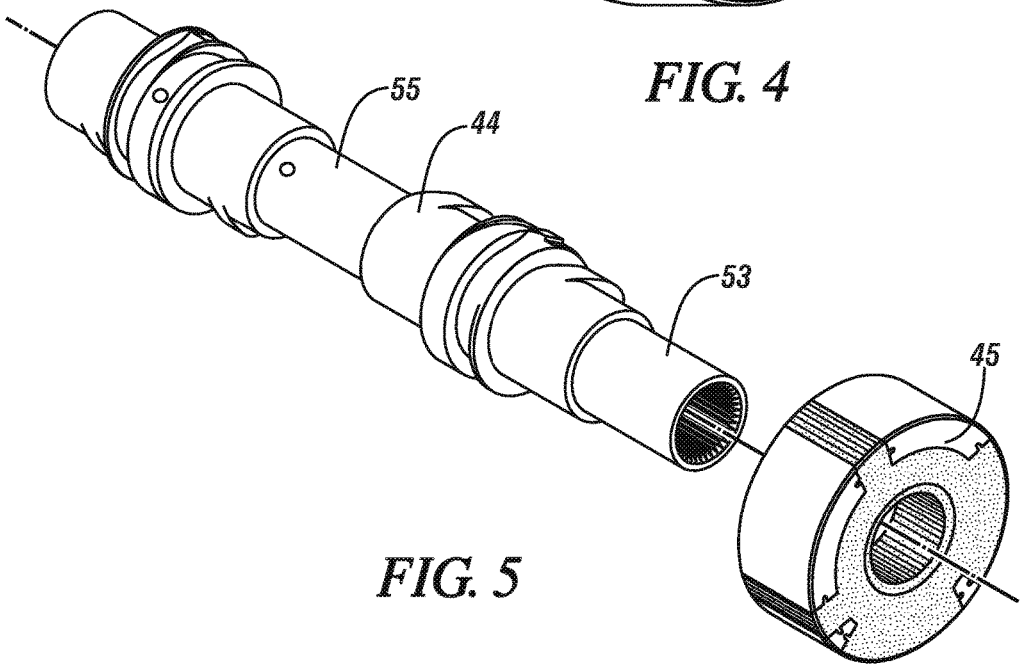
FIG. 5 illustrates an expanded isometric view of a second embodiment of the present disclosure of the trigger wheel, axially movable structure, and base shaft.

With reference to FIGS. 6A-6C, each barrel cam 56 defines a control groove 60 which may be in the form of a "Y." As indicated, the axially movable structure 44 shall be a monolithic structure wherein the barrel cam 56, distal journal 53, standard journals 55 and cams are machined as a single piece. The trigger wheel 45 (also called a "timing wheel") may be mounted on the distal journal 53 in different manners which include, but is not limited to, a press-fit (as shown in FIG. 5). Accordingly, the trigger wheel 45, along with the first, second, third, and fourth lobe packs 46A, 46B, 46C, 46D of the distal axially movable structure 59 can move simultaneously relative to the base shaft 35. As shown, trigger wheel 45 has sufficient width such that sensor 69 maintains its radial distance $Y_5$ to the trigger wheel 45 regardless of whether the trigger wheel 45 is in a first position as shown in FIG. 6A, or in a second position as shown in FIG. 6B, or in a third position as shown in FIG. 6C.

The lobe packs 46A, 46B, 46C, 46D are nevertheless rotationally fixed to the base shaft 35 due to spline feature 48 which in turn is driven by the crankshaft (not shown) via the coupler 40. Consequently, the lobe packs 46A, 46B, 46C, 46D can rotate synchronously with the base shaft 35. Though the drawings show that each axially movable structure 44 includes four lobe packs 46A, 46B, 46C, 46D, each axially movable structure 44 may include more or fewer lobe packs. Furthermore, the number of cams within each lobe pack may vary according the need.

Referring back to FIGS. 7A and 7B, the first, second, third, and fourth lobe packs 46A, 46B, 46C, 46D each define one cam lobe group 50. The barrel cam 56 may, but not necessarily, be disposed between the first and second lobe packs 46A, 46B as shown. However, it is understood that the barrel cam 56 may be disposed anywhere along the axially movable structure shown in FIGS. 7A and 7B. Given that the axially movable structures 44, 57 of the exhaust sliding camshaft 37 in FIGS. 7A and 7B have 2 step cams, only one actuator 34E, 34F may be required to move each axially movable structure 44 as shown in FIGS. 7A-7B.

Referring again to FIGS. 6A-6C and FIGS. 7A-7B, the various cam lobes 54A-54F have a typical cam lobe form with a profile that defines different valve lifts in discrete steps. As a non-limiting example, one cam lobe profile may be circular (e.g., zero lift profile) in order to deactivate a valve. The cam lobes 54A-54F may also have different lobe heights.

The barrel cam 56 includes a barrel cam body 58 and defines a control groove 60 extending into the barrel cam body 58. The barrel cam 56 and the control groove 60 engage with the actuator pins 64A, 64B to move the trigger wheel 45 along the axis together with the distal journal 53, standard journals 55 and the cam lobe packs 46A'-46D' of the axially movable structure 44, 61. The axial movement enables various valve lift as desired while maintaining the trigger wheel 45 at the appropriate distance from the sensor 69. Given that the trigger wheel 45 is mounted on the distal journal 53 of the distal axially movable structure 59. The axis (shown as 43 in FIG. 7A) of the trigger wheel 45 is substantially aligned with the axis 47 of the base shaft 35 which, in turn reduces or eliminates the run-out condition of the trigger wheel 45. Therefore, accurate data from the sensor 69 is sent to the engine control unit 16 (shown in FIG. 2) and enables the engine 14 to run at its optimum level.

Referring again to FIGS. 6A-6C and FIGS. 7A-7B, the control groove 60 is elongated along at least a portion of the circumference of the respective barrel cam body 58. Thus, the control groove 60 is circumferentially disposed along the respective barrel cam body 58. Further, the control groove 60 is configured, shaped, and sized to interact with one of the actuators 34A-34F. As discussed in detail below, the interaction between the actuator 34A-34F causes the axially movable structure 44 (and thus the trigger wheel 45 together with the lobe packs 46A', 46B', 46C', 46D') to move axially relative to the base shaft 35. Despite the axial movement of the trigger wheel 45, the radial distance between the trigger wheel 45 and the sensor 69 remains substantially constant given the broad width of the trigger wheel 45. As shown, the trigger wheel 45 of the present disclosure is approximately three times the width of a standard trigger wheel (shown as 4 in FIG. 1). Furthermore, it is understood that the broad width of the trigger wheel 45 of the present disclosure may be greater or less than 3 times the standard width of a trigger wheel (shown as 4 in FIGS. 1 and 2). The standard width of a trigger wheel 45 is typically 7 mm wide.

With reference to FIGS. 6A-6C and FIGS. 7A-7B, each actuator 34A-34F each includes a corresponding actuator body 62A-62F as shown. First and second pins 64A, 64B are movably coupled to each actuator body 62A-62F. The first and second pins 64A, 64B of each actuator 34A-34F are axially spaced apart from each other and can move independently from each other. Specifically, each of the first and second pins 64A, 64B can move relative to the corresponding actuator body 62A-62F between a retracted position and an extended position in response to an input or command from the control module 16 (FIG. 1). In the retracted position, the first or second pin 64A or 64B is not disposed in the control groove 60. Conversely, in the extended position, the first or second pin 64A or 64B can be at least partially disposed in the control groove 60. The control groove 60 may take on various configurations depending on the need. Accordingly, the first and second pins 64A, 64B can move toward and away from the control groove 60 of the barrel cam 56 in response to an input or command from the control module 16 (FIG. 1). Hence, the first and second pins 64A, 64B of each actuator 34A-34F can move relative to a corresponding barrel cam 56 in a direction substantially perpendicular to the longitudinal axis X.

With reference to FIGS. 7A and 7B, exhaust sliding camshaft 37 may, but not necessarily, include two axially movable structures 44. The first and second lobe packs 46A, 46B of each axially movable structure are operatively associated with a corresponding cylinder 20B, 20D of the engine 14 (as shown in FIGS. 7A and 7B), while the third lobe pack 46C and fourth lobe pack 46D for each axially movable structure 44 are operatively associated with other respective cylinders 20A, 20C in the engine 14. The axially movable structure 44 may also include more or fewer than four lobe packs 46A, 46B, 46C, 46D. Accordingly, the sliding camshaft 33 may, but not necessarily, only include one barrel cam 56 for every two cylinders.

With reference now to the embodiment shown in FIGS. 7A and 7B, the exhaust sliding camshaft 37 is shown wherein the first, second, third, and fourth lobe packs 46A, 46B, 46C, 46D. In FIGS. 7A and 7B, each of the first through fourth lobe packs 46A, 46B, 46C, 46D may, but not necessarily, each includes a first cam lobe 54D, and a second cam lobe 54E. The first cam lobe 54D may have a first maximum lobe height H1. The second cam lobe 54E has a second maximum lobe height H2. The first and second lobe heights H1 and H2 may be different from one another.

In the embodiment depicted in FIGS. 6A-6C, the intake sliding camshaft 39 is shown wherein the first, second, and third cam lobes 54A, 54B, 54C of the lobe packs for cylinders 20B and 20C have different maximum lobe heights (H1>H2>H3). See FIG. 6C showing the relative lobe heights over cylinders 20B and 20C—H1, H2, H3. However, as also shown in FIG. 6C, the second and third cam lobes 54B, 54C in all of the lobe packs used for cylinders 20A and 20D have the same maximum lobe heights. See FIG. 6C showing that H1>H2'=H3. In other words, for lobe packs dedicated to cylinders 20A and 20D, the third maximum lobe height H3 may be equal to the second maximum lobe height H2. Alternatively, for lobe packs dedicated to middle cylinders 20B and 20C, the third maximum lobe height H3 may be different from the second maximum lobe height H2. The maximum lobe heights of the cam lobes 54A, 54B, 54C corresponds to the valve lift of the intake and exhaust valves 26, 30. The sliding camshaft 33 can adjust the valve lift of the intake and exhaust valves 26, 30 by adjusting the axial position of the cam lobes 54A, 54B, 54C relative to the base shaft 35. This can include a zero lift cam profile if desired.

With reference to FIG. 6A-6C, the lobe packs 46A', 46B', 46C', 46D' for each axially movable structure 44, 61 of the intake sliding camshaft 39 can move relative to the base shaft 35 between a first position (FIG. 6A), a second position (FIG. 6B), and a third position (FIG. 6C). To do so, the barrel cams 56 can physically interact with each of the actuators 34A. As discussed above, each barrel cam 56 includes a barrel cam body 58 and defines a control groove 60 extending into the barrel cam body 58. As indicated, given the weight associated with having a three step cam design, two actuators per axially movable structure may be implemented as shown in FIGS. 6A-6C. Accordingly, each axially movable structure may define two barrel cams with control grooves as shown to engage with a corresponding actuator. The control groove 60 is elongated along at least a portion of the circumference of the respective barrel cam body 58.

In FIG. 6A, the axially movable structure 44 of the intake sliding camshaft 39 is in a first position relative to the base shaft 35. When the axially movable structure 44 is in the first position relative to the base shaft 35, the lobe packs 46A', 46B', 46C', 46D' are in the first position and, the first cam lobe 54A of each lobe pack 46A', 46B', 46C', 46D' is substantially aligned with the engine valves 66. The engine valves 66 represent intake or exhaust valves 26, 30 as described above. In the first position, the first cam lobes 54A are operatively coupled to the engine valves 66. As such, the engine valves 66 have a valve lift that corresponds to the first maximum lobe height H1, which is herein referred to as a first valve lift. In other words, when the lobe packs 46A', 46B', 46C', 46D' are in the first position, the engine valves 66 have a first valve lift, which corresponds to the first maximum lobe height H1.

During operation, the trigger wheel 45, the axially movable structure 44 and the lobe packs 46A', 46B', 46C', 46D' can move between a first position (FIG. 6A), a second position (FIG. 6B) and a third position (FIG. 6C) to adjust the valve lift of the engine valves 66 while maintaining a substantially fixed distance (shown as $Y_5$ in FIG. 6A-6C) between the trigger wheel 45 and the sensor 69. As discussed above, in the first position (FIG. 6A), the first cam lobes 54A are substantially aligned with the engine valves 66. The rotation of the lobe pack 46A', 46B', 46C', 46D' causes the engine valves 66 to move between the open and closed positions. When the lobe packs 46A', 46B', 46C', 46D' are in the first position (FIG. 6A), the valve lift of the engine valves 66 may be proportional to the first maximum lobe height H1.

In FIG. 6A, the trigger wheel 45 and each of the axially movable structures 44 of the intake sliding camshaft 39 are in a first position relative to the base shaft 35. When the axially movable structures 44 are in the first position relative to the base shaft 35, the lobe packs 46A', 46B', 46C', 46D' are in the first position and the first cam lobe 54A of each lobe pack 46A', 46B', 46C', 46D' is substantially aligned with the corresponding intake valve 26. Furthermore, the sensor 69 maintains a substantially fixed radial distance (shown as $Y_5$ in FIGS. 6A-6C) between the sensor 69 and the trigger wheel 45. Accordingly, the rotation of the trigger wheel and the sliding camshaft are substantially aligned such that the potential of a runout condition for the trigger wheel 45 is significant reduced. It is understood that distance fluctuation between the trigger wheel 45 and the sensor 69 may be reduced by as much as 200 microns. As indicated, the engine valves 66 represent intake valves 26 as described above. In the third position, the third cam lobes 54C are operatively coupled to the corresponding intake valve 26. As such, the corresponding intake valve 26 has a valve lift that corresponds to the third maximum lobe height H3 (see H3 in FIG. 6C) which is herein referred to as a third valve lift. In other words, when the lobe packs 46A, 46B, 46C, 46D are in the third position, each intake valve 26 has a first valve lift, which corresponds to the third maximum lobe height H3.

To move the axially movable structure 44 from the first position (FIG. 6A) to the second position (FIG. 6B), the control module 16 can command each actuator 34A to move the first pin 64A from the retracted position to the extended position while the base shaft 35 rotates about the longitudinal axis X as shown in FIG. 6A. In the extended position, the first pin 64A is at least partially disposed in the control groove 60. The control groove 60 is therefore configured, shaped, and sized to receive the first pin 64A when the first pin 64A is in the extended position. At this point, the first pin 64A of the actuator 34A rides along the first portion 90 (shown as a non-limiting example in the form of a branch in control groove) of the control groove 60 as the lobe packs 46A', 46B', 46C', 46D' rotate about the longitudinal axis X. While the non-limiting example of a branch is used for the first portion in the control groove, it is understood that the second portion 92 of the control groove may be formed in the control groove in various ways. Accordingly, as the first pin 64A rides along the first portion 90 of control groove 60, the trigger wheel 45, the axially movable structure 44, and the lobe packs 46A', 46B, 46C'. 46D' move axially relative to the base shaft 35 from the first position (FIG. 6A) to the second position (FIG. 6B) in a first direction F (shown in FIG. 6B) while maintaining a fixed radial distance $Y_5$ between the trigger wheel 45 and the sensor 69. Because the control groove 60 has a varying depth, the first pin 64A of the actuator 34A can be moved mechanically to its retracted position as the first pin 64A rides along the control groove 60. Alternatively, the control module 16 can command each actuator 34A-34F to move the first pin 64A to the retracted position.

In FIG. 6B, the trigger wheel 45 together with the axially movable structure 44 are in a second position relative to the base shaft 35. When the trigger wheel 45 and the axially movable structure 44 are in the second position relative to the base shaft 35, the lobe packs 46A', 46B', 46C', 46D' are in the second position and, the second cam lobe 54B of each lobe pack 46A', 46B', 46C', 46D' is substantially aligned with the engine valves 66. The engine valves 66 represent intake valves 26 as described above. In the second position, the second cam lobes 54B are operatively coupled to the engine valves 66 (shown as intake valves 26). As such, the engine valves 66 have a valve lift that corresponds to the second maximum lobe height H2 (FIG. 6B), which is herein referred to as a second valve lift. In other words, when the lobe packs 46A', 46B', 46C', 46D' are in the second position, the engine valves 66 have a second valve lift, which corresponds to the second maximum lobe height H2.

To move the trigger wheel 45 and the axially movable structure 44 from the second position (FIG. 6B) to the third position (FIG. 6C), the control module 16 can command each actuator 34A-34D to move its second pin 64B from the retracted position to the extended position while the base shaft 35 rotates about the longitudinal axis X. In the extended position, the second pin 64B is at least partially positioned in the control groove 60. The control groove 60 is therefore configured, shaped, and sized to receive the second pin 64B when the second pin 64B is in the extended position. At this point, the second pin 64B of each actuator 34A-34D rides along the first portion 90 the control groove 60 as the lobe packs 46A', 46B', 46C', 46D' rotate about the longitudinal axis X. As the second pin 64B rides along the first portion 90 of the control groove 60, the axially movable structure 44 and the lobe packs 46A', 46B', 46C', 46D' move axially relative to the base shaft 35 from the second position (FIG. 6B) to the third position (FIG. 6C) in the first direction F (shown in FIG. 6B). Because the control groove 60 has a varying depth, the second pin 64B of the actuator 34A can be moved mechanically to its retracted position as the second pin 64B rides along the control groove 60. Alternatively, the control module 16 can command each actuator 34A-34D to move the second pin 64B to the retracted position.

To move the trigger wheel 45 and the axially movable structure 44 from the third position (FIG. 6C) to the second position (FIG. 6B), the control module 16 may command each actuator 34A, 34B, 34C to move its second pin 64B from the retracted position to the extended position while the base shaft 35 rotates about the longitudinal axis X. In the extended position, the second pin 64B may be at least partially positioned in the control groove 60. At this point, the second pin 64B of each actuator 34A-34D rides along the second section 92 (FIG. 6C) of the control groove 60 as the lobe packs 46A', 46B', 46C', 46D' rotate about the longitudinal axis X. As the second pin 64B rides along the second section 92 (FIG. 6C) of the control groove 60, the axially movable structure 44 and the lobe packs 46A', 46B', 46C', 46D' move axially relative to the base shaft 35 from the third position (FIG. 6C) to the second position (FIG. 6B) in a second direction R (shown in FIG. 6B). Because the control groove 60 has a varying depth, the second pin 64B of the actuator 34A can be moved mechanically to its retracted position as the second pin 64B rides along the control groove 60. Alternatively, the control module 16 can command each actuator 34A-34D to move the second pin 64B to the retracted position.

To move the trigger wheel 45 and the axially movable structure 44 from the second position (FIG. 6B) to the first position (FIG. 6A), the control module 16 may command each actuator 34A to move its first pin 64A from the retracted position to the extended position while the base shaft 35 rotates about the longitudinal axis X as shown in FIG. 6A. In the extended position, the first pin 64A is at least partially positioned in the control groove 60. At this point, the first pin 64A of the actuator 34A rides along the second portion 92 of the control groove 60 as the lobe packs 46A', 46B', 46C', 46D' rotate about the longitudinal axis X. The second portion 92 is shown as a non-limiting example in the form of a branch in control groove. However, it is understood that the second portion 92 of the control groove may be formed in the control groove in various ways. As the first pin 64A rides along the second portion 92 of the control groove 60, the trigger wheel 45, the axially movable structure 44 and the lobe packs 46A', 46B', 46C', 46D' move axially relative to the base shaft 35 from the second position (FIG. 6B) to the first position (FIG. 6A) in the second direction R. Because the control groove 60 has a varying depth, the first pin 64A of the actuator 34A can be moved mechanically to its retracted position as the first pin 64A rides along the control groove 60. Alternatively, the control module 16 can command each actuator 34A-34D to move the first pin 64A for each actuator 34A-34D to the retracted position.

Figure 8:
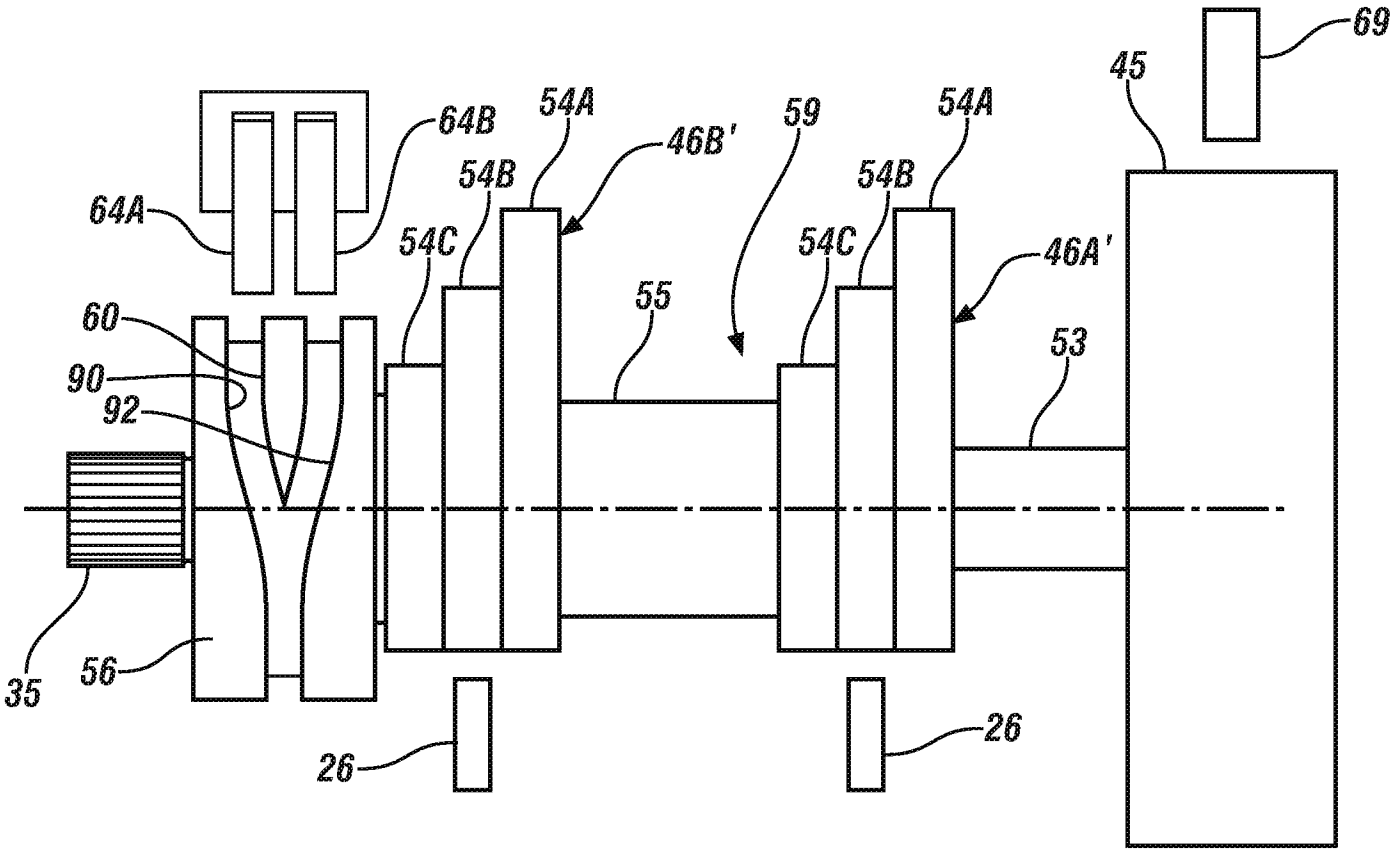
FIG. 8 illustrates a fifth embodiment of the present disclosure where the sliding camshaft includes an axially movable structure having only two lobe packs.

With reference to FIG. 8, a fifth embodiment is shown where the distal axially movable structure 59 includes only two lobe packs 46A', 46B'. It is to be understood that trigger wheel 45 may be mounted directly to distal axially movable structure 59 in a variety of ways, such as but not limited to, the distal journal 53. However, it is to be understood that the trigger wheel 45 may be mounted to any other portion of the distal axially movable structure 59.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A sliding camshaft comprising:

a base shaft extending along a longitudinal axis, the base shaft being configured to rotate about the longitudinal axis;

a distal axially movable structure mounted on the base shaft, the distal axially movable structure being axially movable relative to the base shaft and being rotationally fixed to the base shaft, wherein the distal axially movable structure includes:

a first lobe pack and a second lobe pack, each of the first and second lobe packs including at least one cam lobe, wherein the distal axially movable structure includes a barrel cam defining a control groove;

a standard journal disposed between the first lobe pack and the second lobe pack;

a distal journal disposed on an opposite side of the second lobe pack, the distal journal being integral to the second lobe pack, the standard journal, and the first lobe pack;

a trigger wheel affixed to the distal axially movable structure, the trigger wheel having an over-molded polymeric portion;

an actuator including an actuator body and first and second pins each movably coupled to the actuator body such that each of the first and second pins is movable relative to the actuator body between a retracted position and an extended position, wherein the first and second pins are configured to ride along the control groove;

wherein the trigger wheel and distal axially movable structure are axially movable relative to the base shaft from a first position to a second position when the base shaft rotates about the longitudinal axis, the first pin is in the extended position, the first pin is at least partially disposed in the control groove, and the first pin rides along the control groove;

wherein the distal axially movable structure is axially movable relative to the base shaft from the second position to the first position when the base shaft rotates about the longitudinal axis, the second pin is in the extended position, and the second pin rides along the control groove; and wherein the trigger wheel and a sensor remain at a substantially fixed radial distance from one another regardless of whether the distal axially movable structure is in one of the first position or the second position.

2. The sliding camshaft of claim 1 further comprising a control module in communication with the actuator, wherein at least one of the first and second pins is configured to move between the retracted and extended positions in response to an input from the control module.

3. The sliding camshaft of claim 1, wherein a first cam lobe has a first maximum lobe height and a second cam lobe has a second maximum lobe height such that the first maximum lobe height is different from the second maximum lobe height.

4. The sliding camshaft of claim 3, wherein the first cam lobe is axially adjacent to the second cam lobe.

5. A engine assembly comprising:

an internal combustion engine including a first cylinder, a second cylinder, a first valve operatively coupled to the first cylinder, and a second valve operatively coupled to the second cylinder, wherein the first valve is configured to control fluid flow in the first cylinder, and the second valve is configured to control fluid flow in the second cylinder; and a sliding camshaft operatively coupled to the first and second valves, wherein the sliding camshaft includes:

a base shaft extending along a longitudinal axis, the base shaft being configured to rotate about the longitudinal axis;

a distal axially movable structure and an axially movable structure mounted on the base shaft and each being axially movable relative to the base shaft yet rotationally fixed to the base shaft, wherein the distal axially movable structure and the axially movable structure each include:

a first lobe pack and a second lobe pack with a standard journal there between, and each of the first and second lobe packs including a plurality of cam lobes, the distal axially movable structure and the axially movable structure each further comprising at least one barrel cam, the at least one barrel cam defining a control groove;

a trigger wheel affixed to the distal axially movable structure, the trigger wheel having an over-molded polymeric portion;

an actuator including an actuator body a first pin and a second pin, each of the first and second pins are movable relative to the actuator body between a retracted position and an extended position, wherein the first and second pins are configured to ride along the control groove;

wherein the distal axially movable structure is axially movable relative to the base shaft from a first position to a second position when the base shaft rotates about the longitudinal axis, the first pin is in the extended position, the first pin is at least partially disposed in the control groove, and the first pin rides along a first portion of the control groove;

wherein the distal axially movable structure is axially movable relative to the base shaft from the second position to the first position when the base shaft rotates about the longitudinal axis, the second pin is in the extended position, and the second pin rides along a second portion of the control groove; and wherein the trigger wheel and a sensor remain at a substantially fixed radial distance from one another regardless of whether the distal axially movable structure is in one of the first position or the second position.

* * * * *